US007645306B2

(12) United States Patent
Kanazirev

(10) Patent No.: US 7,645,306 B2
(45) Date of Patent: Jan. 12, 2010

(54) REMOVAL OF MERCURY FROM FLUIDS BY SUPPORTED METAL OXIDES

(75) Inventor: Vladislav I. Kanazirev, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 141 days.

(21) Appl. No.: 11/955,470

(22) Filed: Dec. 13, 2007

(65) Prior Publication Data

US 2009/0155148 A1 Jun. 18, 2009

(51) Int. Cl.
*C10L 3/10* (2006.01)

(52) U.S. Cl. ..... 48/127.3; 48/127.5; 48/127.7; 423/210; 423/242.1; 423/244.06; 95/134

(58) Field of Classification Search ..... 423/210, 423/242.1, 244.06; 95/134; 48/127.3, 127.5, 48/127.7
See application file for complete search history.

(56) References Cited

U.S. PATENT DOCUMENTS

| | | | | |
|---|---|---|---|---|
| 2,915,365 | A | 12/1959 | Saussol | 23/142 |
| 4,044,098 | A | 8/1977 | Miller et al. | |
| 4,094,777 | A | 6/1978 | Sugier et al. | 210/32 |
| 5,120,915 | A | 6/1992 | Doherty | |
| 5,607,496 | A * | 3/1997 | Brooks | 75/670 |
| 6,383,981 | B1 * | 5/2002 | Blankenship et al. | 502/406 |
| 7,060,233 | B1 | 6/2006 | Srinivas et al. | |
| 2006/0252642 | A1 | 11/2006 | Kanazirev | 502/415 |
| 2006/0261011 | A1 | 11/2006 | Kanazirev et al. | 210/688 |
| 2007/0160517 | A1 * | 7/2007 | Fan et al. | 423/210 |
| 2008/0307960 | A1 * | 12/2008 | Hendrickson et al. | 95/28 |

FOREIGN PATENT DOCUMENTS

| | | | |
|---|---|---|---|
| GB | 2387391 | A | 10/2003 |

* cited by examiner

*Primary Examiner*—Timothy C Vanoy
(74) *Attorney, Agent, or Firm*—Mark Goldberg

(57) ABSTRACT

This invention relates to the use of a copper oxide adsorbent to remove mercury from a feed stream. When the feed stream is low in sulfur content, a sulfidation agent such as hydrogen sulfide should be added to the feed stream.

11 Claims, No Drawings

REMOVAL OF MERCURY FROM FLUIDS BY SUPPORTED METAL OXIDES

BACKGROUND OF THE INVENTION

The present invention relates to the removal of contaminants from hydrocarbon liquids and gases. More particularly, the invention relates to the use of a copper oxide adsorbent to remove sulfur and mercury from natural gas streams.

Fluid streams, such as hydrocarbon liquids and gases, such as natural gas, are often contaminated with sulfur compounds and other contaminants such as elemental mercury. Supported metal sulfides such as cupric sulfide CuS are known scavengers for mercury from fluids. For example, U.S. Pat. No. 4,094,777 describes a solid mass which contains a carrier and sulfided copper as absorbent for mercury from a gas or a liquid. CuS based materials for Hg removal are offered by Axens, JMC and others for applications in natural gas and hydrocarbon industry. However, there is a need for more efficient absorbents of mercury, especially in the case of sulfur free streams and in the presence of reducing agents such as hydrogen in the feed.

SUMMARY OF THE INVENTION

The present invention provides a process for purifying a natural gas feed stream containing at least one sulfur contaminant and at least one mercury contaminant by passing the feed stream through an adsorbent bed comprising a metal oxide sorbent on a support. Copper oxide is the preferred sorbent.

The invention uses metal oxides such as cupric oxide supported on an alumina carrier with high BET surface area whereas a sulfur compound, preferably hydrogen sulfide is being constantly admixed to the feed to be purified in a concentration that exceeds the Hg concentration in the feed by a factor of at least 3. This greatly improves mercury removal by increasing the driving force for the process by in situ producing the Cu sulfide intermediates needed to bind the mercury while suppressing the competing reactions with the feed components that lead to copper phases which are not suitable for Hg removal.

DETAILED DESCRIPTION

A preferred way to practice the invention is to assure that sulfur compounds that can easily react with CuO are present in the Hg-containing feed stream while the stream passes through the Hg removal sorbent. The sorbent contains cupric oxide—CuO on a high surface area support.

A preferred method for preparing the sorbent starts with basic copper carbonates such as $CuCO_3.Cu(OH)_2$ that can be produced by precipitation of copper salts, such as $Cu(NO)_3$, $CuSO_4$ and $CuCl_2$, with sodium carbonate. Depending on the conditions used, and especially on washing the resulting precipitate, the final material may contain some residual product from the precipitation process. In the case of the $CuCl_2$ raw material, sodium chloride is a side product of the precipitation process. It has been determined that a commercially available basic copper carbonate that had both residual chloride and sodium, exhibited lower stability towards heating and improved resistance towards reduction than another commercial BCC that was practically chloride-free.

In some embodiments of the present invention, agglomerates are formed comprising a support material such as alumina, copper oxide and halide salts. The alumina is typically present in the form of transition alumina which comprises a mixture of poorly crystalline alumina phases such as "rho", "chi" and "pseudo gamma" aluminas which are capable of quick rehydration and can retain substantial amount of water in a reactive form. An aluminum hydroxide $Al(OH)_3$, such as Gibbsite, is a source for preparation of transition alumina. The typical industrial process for production of transition alumina includes milling Gibbsite to 1-20 microns particle size followed by flash calcination for a short contact time as described in the patent literature such as in U.S. Pat. No. 2,915,365. Amorphous aluminum hydroxide and other naturally found mineral crystalline hydroxides e.g., Bayerite and Nordstrandite or monoxide hydroxides (AlOOH) such as Boehmite and Diaspore can be also used as a source of transition alumina. In the experiments done in reduction to practice of the present invention, the transition alumina was supplied by the UOP LLC plant in Baton Rouge, La. The BET surface area of this transition alumina material is about 300 $m^2/g$ and the average pore diameter is about 30 angstroms as determined by nitrogen adsorption.

Typically, a solid oxysalt of a transitional metal is used as a component of the composite material. "Oxysalt", by definition, refers to any salt of an oxyacid. Sometimes this definition is broadened to "a salt containing oxygen as well as a given anion". FeOCl, for example, is regarded as an oxysalt according this definition. For the purpose of the examples presented of the present invention, we used basic copper carbonate (BCC), $CuCO_3Cu(OH)_2$ which is a synthetic form of the mineral malachite, produced by Phibro Tech, Ridgefield Park, N.J. The particle size of the BCC particles is approximately in the range of that of the transition alumina—1-20 microns. Another useful oxysalt would be Azurite—$Cu_3(CO_3)_2(OH)_2$ Generally, oxysalts of copper, nickel, iron, manganese, cobalt, zinc or a mixture of elements can be successfully used.

A copper oxide sorbent is produced by combining an inorganic halide additive with a basic copper carbonate to produce a mixture and then the mixture is calcined for a sufficient period of time to decompose the basic copper carbonate. The preferred inorganic halides are sodium chloride, potassium chloride or mixtures thereof. Bromide salts are also effective. The chloride content in the copper oxide sorbent may range from 0.05 to 2.5 mass-% and preferably is from 0.3 to 1.2 mass-%. Various forms of basic copper carbonate may be used with a preferred form being synthetic malachite, $CuCO_3Cu(OH)_2$.

The copper oxide sorbent that contains the halide salt exhibits a higher resistance to reduction than does a similar sorbent that is made without the halide salt. The preferred halide is a chloride. Other methods of preparing a metal oxide containing adsorbent may be prepared as are known to those skilled in the art.

The support material that is used may be selected from the group consisting of carbon, activated carbon, coke, silica, aluminas, silica-aluminas, silicates, aluminates and silico-aluminates such as zeolites. Preferably the support is chose from the group consisting of silica, aluminas, silica-aluminas, silicates, aluminas and silicoaluminates and preferably alumina is used.

It is calculated that the driving force for Hg removal increases tremendously when the Hg removal reaction combines with the sulfidation reaction of CuO to produce the final product HgS. The following table lists the logarithm of the equilibrium constants involved in the removal process.

| | Log K equilibrium at temperature, ° C. | | | |
|---|---|---|---|---|
| | 20 | 40 | 60 | 80 |
| Hg Removal Reaction | | | | |
| $CuO + H_2S(g) = CuS + H_2O(g)$ | 22.1 | 20.7 | 19.5 | 18.4 |
| $2CuS + Hg(g) = HgS + Cu_2S$ | 10.3 | 9.3 | 8.4 | 7.6 |
| $2CuO + Hg(g) + 2H_2S(g) = HgS + Cu_2S + 2H_2O(g)$ | 54.4 | 50.6 | 47.3 | 44.4 |
| $Cu_2S + Hg(g) = HgS + 2Cu$ | −0.3 | −0.7 | −1.1 | −1.5 |
| Competing Reaction | | | | |
| $2CuS + H_2(g) = Cu_2S + H_2S$ | 1.1 | 1.2 | 1.3 | 1.4 |

It can be seen that the reaction $2CuO+Hg(g)+2H_2S(g)=HgS+Cu_2S+2H_2O(g)$ is the most preferred option. This reaction assures also the lowest Hg concentration in the gas phase in equilibrium with the sorbent material.

The sorbent contains between 5 and 65% CuO, preferably between 10 and 40%. It can be produced by the common ways of impregnation or co-nodulizing, for example. Alumina is the preferred carrier whereas the BET surface area of the composite material exceeds preferably 200 $m^2/g$.

The use of the adsorbent slows down the competing reaction in which $2CuS+H_2=Cu_2S+H_2S$. This hydrogenation reaction is normally highly favored thermodynamically. It is advantageous that the adsorbent component slows this copper reduction reaction.

The invention can be practiced in the common fixed bed reactors with Hg containing feed. $H_2S$ is preferred as a sulfidation component of the stream. Its concentration expressed in moles should exceeds that of the total Hg in the stream by a factor of at least 2.5. The sulfidation agent may be a part of the feed. If no S is available in the feed, a small slip stream fed to the bed inlet should provide the S amount necessary for the combined CuO—Hg—$H_2S$ reaction to occur.

The invention claimed is:

1. A process of purifying a natural gas feed stream containing at least one sulfur contaminant and at least one mercury contaminant comprising passing said feed stream through an adsorbent bed comprising a sorbent comprising a metal oxide on a support wherein a sulfidation component is added to said feed stream.

2. The process of claim 1 wherein said metal oxide is copper oxide.

3. The process of claim 1 wherein said sorbent comprises 5 to 65% copper oxide.

4. The process of claim 1 wherein said sorbent comprises 10 to 40% copper oxide.

5. The process of claim 1 wherein said support is selected from the group consisting of silicas, aluminas, silica-aluminas, silicates, aluminas and silicoaluminates.

6. The process of claim 1 wherein said support is an alumina.

7. The process of claim 1 wherein said sorbent has a BET surface area greater than 200 $m^2/g$.

8. The process of claim 1 wherein said sulfidation component is hydrogen sulfide.

9. The process of claim 1 wherein said sorbent contains an additive that retards copper reduction to a lower valent state.

10. The process of claim 9 wherein said additive contains a halide anion.

11. The process of claim 10 wherein said halide is a chloride.

* * * * *